US008274225B2

(12) United States Patent
Suzuki

(10) Patent No.: US 8,274,225 B2
(45) Date of Patent: Sep. 25, 2012

(54) IMAGE DISPLAY APPARATUS

(75) Inventor: Norihiro Suzuki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 396 days.

(21) Appl. No.: 12/754,326

(22) Filed: Apr. 5, 2010

(65) Prior Publication Data

US 2010/0259171 A1 Oct. 14, 2010

(30) Foreign Application Priority Data

Apr. 8, 2009 (JP) ..... 2009-094044

(51) Int. Cl.
*H01K 1/62* (2006.01)

(52) U.S. Cl. ..... 315/52; 315/39.57; 315/111.81; 445/50; 445/51

(58) Field of Classification Search ..... 315/51–53, 315/39.57, 111.81; 445/50–51
See application file for complete search history.

(56) References Cited

U.S. PATENT DOCUMENTS

| | | | | |
|---|---|---|---|---|
| 5,593,335 | A * | 1/1997 | Suzuki et al. | 445/50 |
| 5,853,310 | A * | 12/1998 | Nishimura et al. | 445/24 |
| 6,225,749 | B1 | 5/2001 | Kobayashi et al. | |
| 6,445,367 | B1 | 9/2002 | Suzuki et al. | |
| 6,534,924 | B1 | 3/2003 | Oquchi et al. | |
| 6,677,706 | B1 | 1/2004 | Hara et al. | |
| 6,802,753 | B1 * | 10/2004 | Ando et al. | 445/6 |
| 6,896,571 | B2 | 5/2005 | Mizuno et al. | |
| 7,077,716 | B2 | 7/2006 | Mizuno et al. | |
| 7,097,530 | B2 * | 8/2006 | Katakura et al. | 445/50 |
| 7,135,823 | B2 | 11/2006 | Suzuki et al. | |
| 7,249,989 | B2 * | 7/2007 | Hayama | 445/25 |
| 7,400,082 | B2 | 7/2008 | Suzuki et al. | |
| 7,492,087 | B2 | 2/2009 | Hara et al. | |
| 2003/0062483 | A1 | 4/2003 | Cimino et al. | |
| 2005/0276096 | A1 | 12/2005 | Hara et al. | |
| 2006/0290617 | A1 * | 12/2006 | Miyazawa | 345/76 |
| 2007/0241656 | A1 | 10/2007 | Hara et al. | |
| 2009/0002586 | A1 * | 1/2009 | Kimura | 349/39 |
| 2009/0051674 | A1 * | 2/2009 | Kimura et al. | 345/204 |
| 2009/0160313 | A1 | 6/2009 | Yamazaki et al. | |
| 2009/0273270 | A1 | 11/2009 | Suzuki | |
| 2010/0060141 | A1 | 3/2010 | Kubota et al. | |

FOREIGN PATENT DOCUMENTS

| | | |
|---|---|---|
| JP | 10-326583 A | 8/1998 |
| JP | 3199682 B2 | 8/2001 |
| JP | 2003-157757 A | 5/2003 |

* cited by examiner

*Primary Examiner* — Jason M Crawford
(74) *Attorney, Agent, or Firm* — Fitzpatrick, Cella, Harper & Scinto

(57) ABSTRACT

An image display apparatus according to the present invention comprises a plurality of electron emitting devices having an electron emitting portion provided between a cathode electrode and a gate electrode; a cathode wiring connected to the cathode electrode; and a gate wiring connected to the gate electrode and having a resistance higher than the resistance of the cathode wiring, wherein an impedance element having a resistance value of Ry and an electrostatic capacitance of Cy is connected to between the cathode wiring and the cathode electrode, a resistive element having a resistance value of Rx is connected to between the gate wiring and the gate electrode, and $|Ry/(1+j\omega RyCy)|<Rx$ and $Ry>Rx$ are satisfied, where $\omega$ is 100 MHz.

2 Claims, 5 Drawing Sheets

IMAGE DISPLAY APPARATUS

BACKGROUND OF THE INVENTION

1. Field of the Invention

The present invention relates to an image display apparatus.

2. Description of the Related Art

Conventionally, there has been known an image display apparatus using an electron emitting apparatus which utilizes an electron emitting device. As an example of the image display apparatus, there is a flat electron beam display panel having an electron source substrate (rear plate) and an anode substrate (faceplate). The rear plate has a plurality of cold-cathode electron emitting devices. The face plate has a plurality of phosphors respectively facing a plurality of electron emitting devices and an anode electrode (a metal back or a transparent electrode) covering the phosphors. When a voltage is applied to between the electron emitting device and the anode electrode, electrons emitted from the electron emitting device are accelerated and collide with the phosphor, whereby the phosphor emits light, and an image is displayed.

The electron emitting device has a cathode electrode, a gate electrode, and an electron emitting portion. The cathode electrode is connected to a cathode wiring (a scanning wiring), and the gate electrode is connected to a gate wiring (a signal wiring) and having a resistance higher than the resistance of the scanning wiring. A voltage is applied to between the cathode electrode and the gate electrode through each of those wirings, whereby electrons are emitted from the electron emitting portions.

In this image display apparatus, it is desirable that the electron emitting devices have uniform electron emission characteristics (the amount of emitted electrons to a voltage; emission current Ie). However, it is difficult to produce a plurality of electron emitting devices so that the electron emission characteristics are uniformized. Therefore, in the related art, a resistive element (a ballast resistance) with a large resistance value is connected to between the cathode electrode and the scanning wiring, and consequently, variation in the electron emission characteristics is reduced.

Further, in the above image display apparatus, in order to obtain a high emission luminance, a high voltage is applied to between the electron emitting device and the anode electrode. The electrons emitted from the electron emitting device are scattered until reaching the phosphor and the anode electrode. Thus, in order to realize a high-definition image display apparatus (a display), the distance between the electron emitting device and the anode electrode is reduced.

Therefore, a high electric field is formed between the face plate and the rear plate, and accidental electrical discharge may occur therebetween, resulting in, for example, breaking of the electron emitting device and a failure of a drive circuit for use in the application of a voltage to the cathode electrode and the gate electrode. Specifically, an accidental large current (a discharge current) due to electrical discharge is applied into the drive circuit, leading to a failure of the drive circuit. A failure of a drive circuit, connected to a signal wiring with a small power capacity, easily occurs compared to a drive circuit connected to a scanning wiring. When an accidental large current (a discharge current) due to electrical discharge is applied into the electron emitting device, not only the electron emitting device is broken, but also a potential on the gate electrode is increased due to wiring resistance. Consequently, a high potential is applied to adjacent devices connected through the signal wiring, leading to an effect on a discharge current of the adjacent devices.

Thus, only by connecting the ballast resistance to between the cathode electrode and the scanning wiring, there cannot be solved a problem that the electron emission amount is varied due to accidental electrical discharge.

In order to solve the above problem that occurs when a discharge occurs, the impedance of the scanning wiring may be rendered lower than the impedance of the signal wiring. Namely, a discharge current may be applied to the drive circuit connected to the scanning wiring. Specifically, a resistive element A may be connected to between the signal wiring and the gate electrode. This configuration is disclosed in, for example, Japanese Patent Application Laid-Open No. 2003-157757.

Japanese Patent Application Laid-Open No. 2003-157757 discloses suppression of the inflow of a discharge current into the signal wiring, but does not disclose reduction of the variation in the electron emission characteristics. Although Japanese Patent Application Laid-Open No. 2003-157757 discloses that a resistive element B is connected to between the scanning wiring and the cathode electrode, a discharge current is not applied to the signal wiring, and therefore, the resistance value of the resistive element B is set to be smaller than the resistance value of the resistive element A. Therefore, the resistive element B does not function as a ballast resistance sufficiently, and thus, the variation in the electron emission characteristics cannot be reduced upon normal driving.

Meanwhile, when the resistance value of the resistive element B is rendered larger to such an extent that the resistive element B expresses the function as a ballast resistance, while maintaining such a relation that the resistance value of the resistive element A is larger than the resistance value of the resistive element B, the resistance value of the resistive element A is also increased with the increase of the resistance value of the resistive element B. Therefore, there arises a problem that the electron emitting device cannot be driven.

SUMMARY OF THE INVENTION

In view of the above problem, the present invention provides an image display apparatus which can prevent inflow of a discharge current into a gate wiring and can reduce variation in electron emission characteristics.

The present invention in its first aspect provides an image display apparatus comprising:

a plurality of electron emitting devices having an electron emitting portion provided between a cathode electrode and a gate electrode;

a cathode wiring connected to the cathode electrode; and a gate wiring connected to the gate electrode and having a resistance higher than the resistance of the cathode wiring, wherein an impedance element having a resistance value of Ry and an electrostatic capacitance of Cy is connected to between the cathode wiring and the cathode electrode, a resistive element having a resistance value of Rx is connected to between the gate wiring and the gate electrode, and $|Ry/(1+j\omega RyCy)|<Rx$ and $Ry>Rx$ are satisfied, where $\omega$ is 100 MHz.

The present invention in its second aspect provides an image display apparatus comprising:

a plurality of electron emitting devices having an electron emitting portion provided between a cathode electrode and a gate electrode;

a cathode wiring connected to the cathode electrode; and a gate wiring connected to the gate electrode and having a resistance higher than the resistance of the cathode wiring, wherein a first resistive element having a resistance value of Ry and a capacitive element having an electrostatic capacitance of Cy are connected in parallel between the cathode wiring and the cathode electrode, a second resistive element having a resistance value of Rx is connected to between the gate wiring and the gate electrode, and $|Ry/(1+j\omega RyCy)|<Rx$ and $Ry>Rx$ are satisfied, where $\omega$ is 100 MHz.

The present invention can provide an image display apparatus which can prevent inflow of a discharge current into a gate wiring and can reduce variation in electron emission characteristics.

Further features of the present invention will become apparent from the following description of exemplary embodiments with reference to the attached drawings.

DESCRIPTION OF THE EMBODIMENTS

Hereinafter, an image display apparatus according to the present embodiment will be described. In the image display apparatus, electrons emitted from an electron emitting device on a rear plate are irradiated to a phosphor on a face plate, whereby the phosphor is made to emit light, and an image is displayed. The electron emitting device includes a field emission type electron emitting device, a MIM type electron emitting device, and a surface conduction electron emitting device. In the following description, the surface conduction electron emitting device is used as the electron emitting device.

Figure 4:
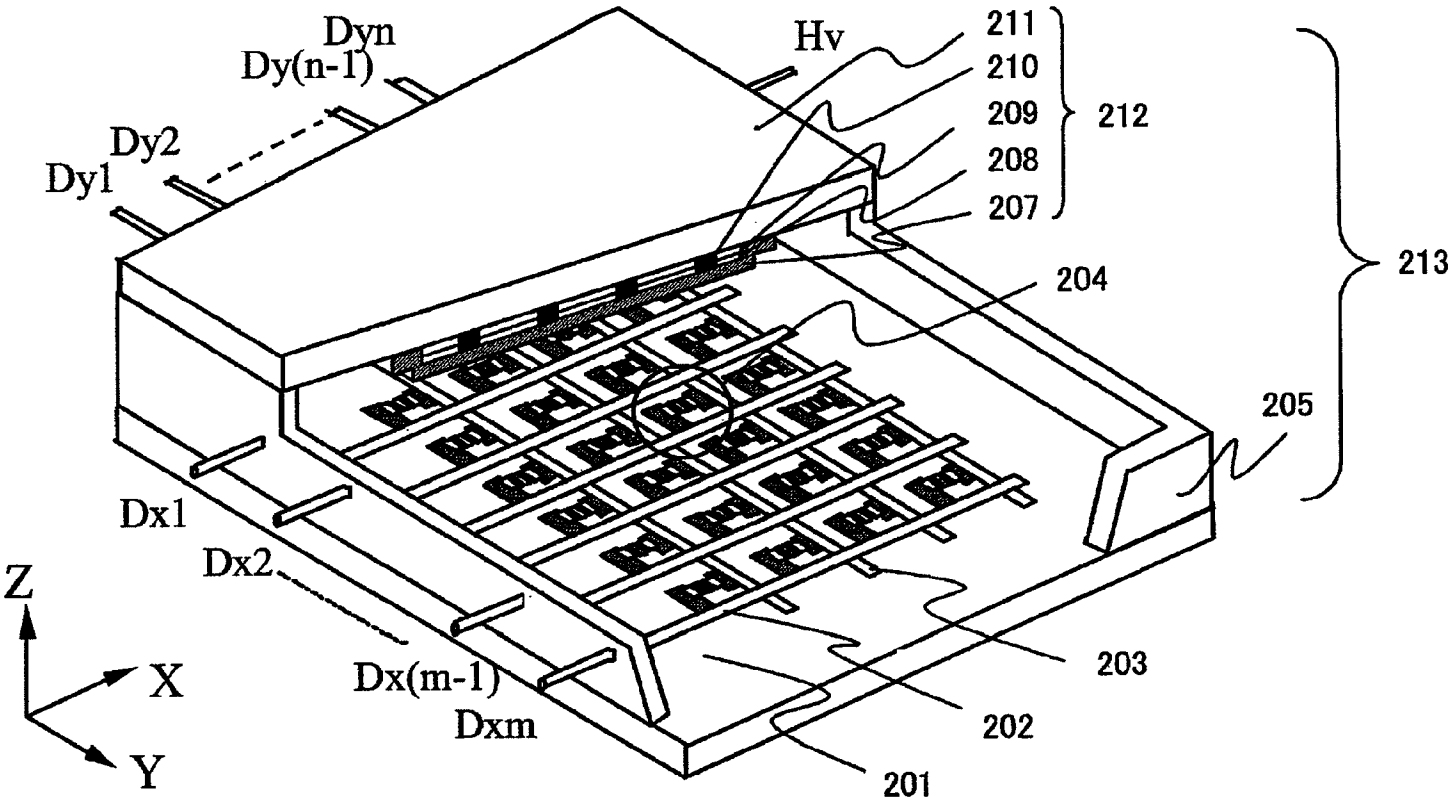
FIG. 4 is a schematic configuration diagram of an image display apparatus according to the present embodiment.

FIG. 4 is a schematic configuration diagram of an electron beam display panel as an example of the image display apparatus according to the present embodiment. In FIG. 4, the electron beam display panel includes an electron source substrate (rear plate) 201, an anode substrate (face plate) 212, and an outer flame 205. The edge portion of the rear plate 201 and the edge portion of the face plate 212 are fixed to the outer flame 205. The rear plate 201, the face plate 212, and the outer flame 205 constitute an outer case 213. The inside of the outer case 213 is kept in a vacuum state.

The rear plate 201 has a cathode wiring 202 (scanning wiring), a gate wiring 203 (signal wiring), and a plurality of electron emitting devices 204. The electron emitting device 204 has a cathode electrode, a gate electrode, and an electron emitting portion located between the cathode electrode and the gate electrode. The cathode wiring 202 and the gate wiring 203 are electroconductive wirings connected to a device electrode of the electron emitting device 204. Specifically, the cathode wiring 202 is connected to the cathode electrode, and the gate wiring 203 is connected to the gate electrode. The cathode wiring 202 is also connected to terminals Dy (n) (n is an arbitrary number) connected to a scanning drive circuit. The gate wiring 203 is also connected to terminals Dx (m) (m is an arbitrary number) connected to a signal drive circuit.

Further, at each intersection of the cathode wiring 202 with the gate wiring 203, there is provided an inter-wiring insulating layer (not illustrated) for use in electrical insulation between these wirings. In the present embodiment, the cathode wiring 202 and the gate wiring 203 are wired to the electron emitting devices 204 in the form of a matrix.

The faceplate 212 has a glass substrate 211, a black matrix 210, a strip-shaped transparent electrode 209, a plurality of phosphors (light emitters or fluorescent films) 208, and a metal back (anode electrode) 207. Each of the phosphors 208 is arranged to face the electron emitting devices. The metal back 207 is provided to cover the phosphors 208.

The metal back 207 is provided for use in acceleration of electrons (emission electrons) emitted from the electron emitting device 204. Specifically, a voltage (an anode voltage) is applied to between the electron emitting device 204 and the metal back 207, whereby the emission electrons are accelerated to be collided with the phosphor 208. Consequently, the phosphor 208 emits light, and an image is displayed. In order to obtain a luminescent spot of a higher luminance, a high voltage Hv is applied to between the electron emitting device 204 and the metal back 207 so that the potential of the metal back 207 is high higher than that of electron emitting device 204. The voltage applied to between the electron emitting device 204 and the metal back 207 is, depending on the characteristics of the phosphor 208, approximately several hundred V to several ten kV. Therefore, a distance d between the rear plate 201 and the face plate 212 is generally set to be approximately several hundred μm to several mm so that a vacuum breakdown (that is, electrical discharge) can be prevented.

In this image display apparatus, a predetermined voltage is applied to the cathode wiring 202 and the gate wiring 203, whereby the electron emitting devices 204 are selectively driven. Specifically, electrons are emitted from the electron emitting device 204 located at the intersection of the cathode wiring 202 with the gate wiring 203, to which a voltage is applied. The emitted electrons are then irradiated to the phosphor 208 facing the electron emitting device 204 having emitted the electrons, and a luminescent spot is obtained at a predetermined position. The gradation of luminance may be controlled by a pulse width of an applied voltage, by the magnitude (amplitude) of the applied voltage, or by combining both of them. In the present embodiment, a plurality of electron emitting devices are line-sequentially driven.

In the present embodiment, a resistive element (a ballast resistance) having a satisfactorily large resistance value relative to the device resistance is connected to the electron emitting device in series. Since the electrons flow into the device from the low potential side, the ballast resistance is connected to the low potential side of the electron emitting device (between the cathode wiring and the cathode electrode). According to this configuration, variation in device resistance can be apparently reduced, and the uniform emission current amount (the electron emission characteristics) can be realized.

However, only by connecting the ballast resistance, when accidental electrical discharge (abnormal electrical discharge) occurs (due to, for example, a rapid increase of an anode voltage and adhesion of foreign matters upon manufacturing), there arises the following problem. Namely, when a ballast resistance having a high resistance value is connected to the cathode wiring side of the device, a discharge current flows more on the gate wiring side. Consequently, a signal drive circuit may be broken. In general, the phosphors of three colors R, G, and B are arranged in a direction of arrangement of the gate wiring. Thus, due to a spatial problem, the gate wiring has a width smaller than the width of the cathode wiring and a resistance higher than the resistance of the cathode wiring. Therefore, when a discharge current flows into the gate electrode, the potential of the gate wiring is significantly increased due to the wiring resistance. Consequently, a high potential is applied to the adjacent devices connected through the gate wiring, possibly leading to deterioration of the electron emission characteristics of the adjacent devices.

Meanwhile, when a plurality of electron emitting devices are line-sequentially driven, the device current of the electron emitting device arranged in one direction (a row direction or a column direction) flows into a scanning drive circuit at once. Therefore, the scanning drive circuit generally has a large power capacity in comparison with the signal drive circuit. Thus, the flow of a discharge current into the scanning drive circuit can reduce a failure of a drive circuit more than in the case of flowing the discharge current into the signal drive circuit. Since the resistance value of the cathode wiring can be rendered smaller than the resistance value of the gate wiring, the discharge current dominantly flows to the cathode wiring, whereby the deterioration as described above can be suppressed.

Thus, in the present embodiment, upon normal driving, by virtue of a ballast resistance, the electron emission characteristics of a plurality of electron emitting devices are uniformized, and when accidental electrical discharge occurs, a discharge current is made to flow to a cathode wiring and a scanning drive circuit. Hereinafter, a configuration for realizing that will be described in detail.

Figure 1:
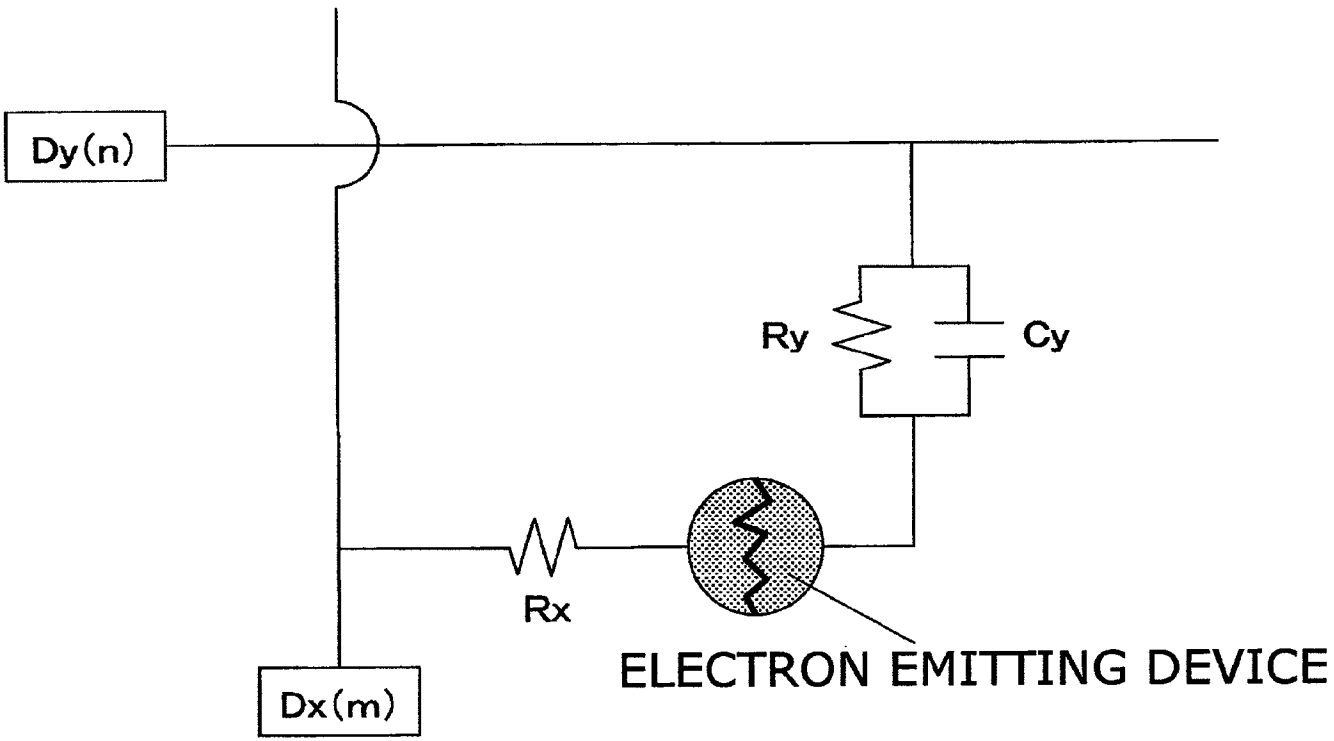
FIG. 1 is a schematic diagram of an equivalent circuit of an element structure on a rear plate according to the present embodiment.

FIG. 1 is a schematic diagram of an equivalent circuit of an element structure on a rear plate. As illustrated in FIG. 1, a first resistive element having a resistance value of Ry and a capacitive element having an electrostatic capacitance of Cy are connected in parallel between a cathode wiring and a cathode electrode. Further, a second resistive element having a resistance value of Rx is connected to between the gate wiring and the gate electrode.

Since a ballast resistance is provided on the cathode wiring side, Rx and Ry are set to satisfy $Ry>Rx$ (1).

Further, Rx, Ry, and Cy are set so that when a high-frequency current such as a discharge current flows, the impedance on the cathode wiring is smaller than the impedance on the gate wiring. Specifically, Rx, Ry, and Cy are set to satisfy $|Ry/(1+j\omega RyCy)|<Rx$ (2) (the frequency ω is a frequency of a discharge current or the like). In other words, an RC parallel circuit including the first resistive element (Ry) and the capacitive element (Cy) is connected to the cathode wiring side of the electron emitting device, and the second resistive element (Rx) whose impedance to a high-frequency current such as a discharge current is larger than the impedance of the RC parallel circuit is connected to the gate wiring side.

The left-hand side of the formula (2) is a general formula for the calculation of the impedance of a parallel circuit (RC parallel circuit) including a resistive element and a capacitive element. Rx is preferably not less than 500Ω for the purpose of protecting the signal drive circuit. Ry is preferably approximately 1 MΩ to 1 GΩ for the purpose of suppressing variation in the emission current Ie (that is, for the purpose of fulfilling the function as a ballast resistance). For example when Rx=500Ω, Cy is preferably not less than 0.3 pF. However, if the magnitude of Cy is increased, the increase adversely affects a drive waveform of the cathode wiring and the gate wiring, and therefore, the magnitude of Cy is preferably several hundred fF.

Figure 5:
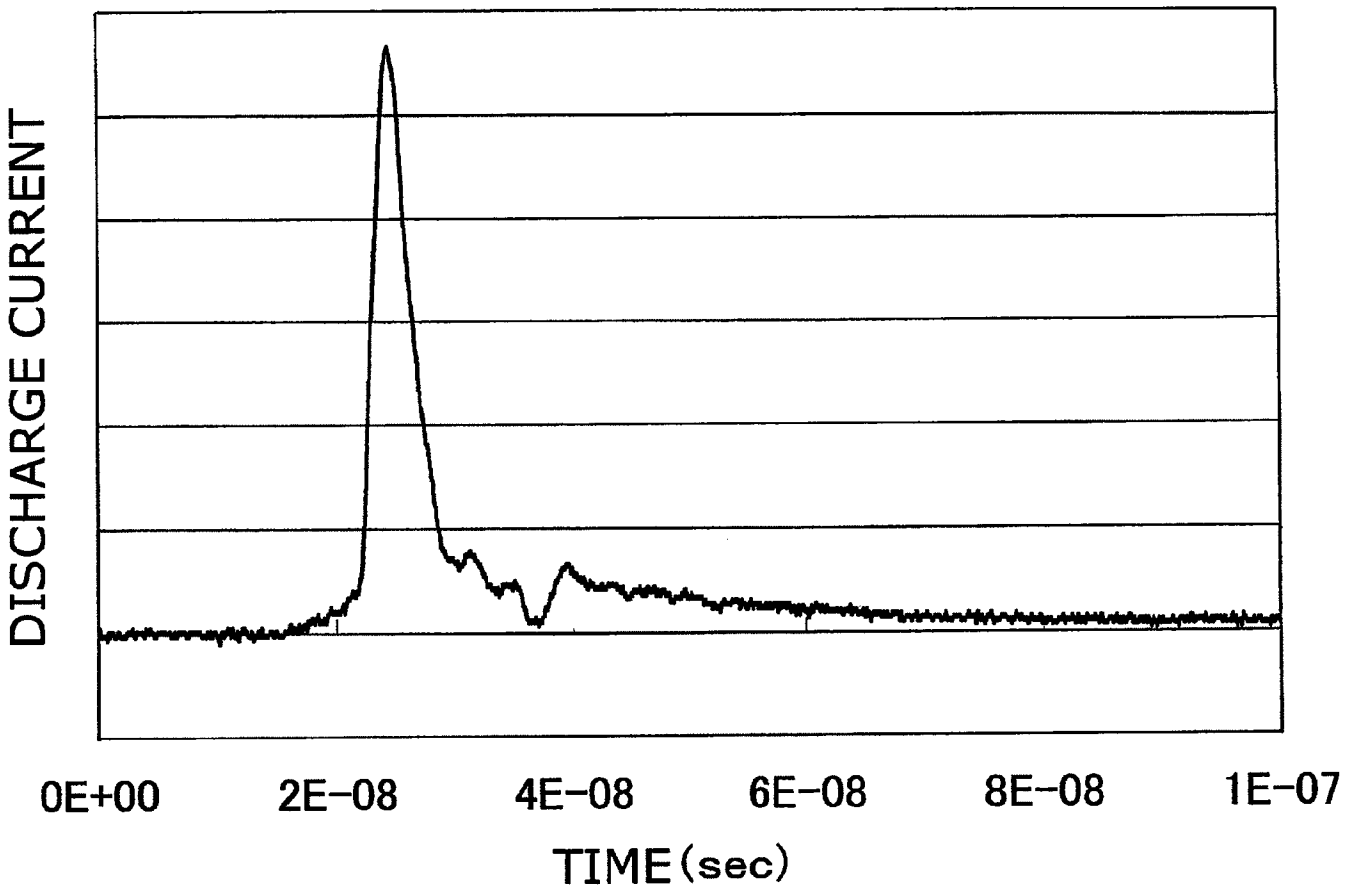
FIG. 5 is a view illustrating a change in a discharge current when accidental electrical discharge occurs.

As a result of intensive studies made by the present inventors, it has been found that when accidental electrical discharge occurs in the above image display apparatus, the discharge current as illustrated in FIG. 5 is observed. In FIG. 5, the vertical axis represents values of the discharge current, and the horizontal axis represents a time. As illustrated in FIG. 5, the discharge current precipitously increases from the occurrence of electrical discharge to approximately 2.5 nsec to exhibit the maximum value. Thereafter, the discharge current rapidly attenuates during approximately 2.5 nsec (5 nsec from the occurrence of electrical discharge) and is then gently reduced. Thus, the discharge current has a frequency of 100 MHz or more. Therefore, when at least the frequency ω is 100 MHz, $|Ry/(1+j\omega RyCy)|<Rx$ may be satisfied. Consequently, when electrical discharge occurs, the impedance (the resistance value) on the cathode wiring side can be rendered smaller than the impedance on the gate wiring side, and the discharge current can be allowed to dominantly flow in the cathode wiring (the scanning drive circuit). Namely, the inflow of the discharge current into the gate wiring can be suppressed. Meanwhile, a low-frequency current (for example, a current of several MHz) such as a current flowing to a device upon normal driving flows not through the capacitive element but mainly through the first resistive element. Thus, the impedance (the resistance value) on the cathode wiring upon normal driving is substantially Ry, and the function as a ballast resistance is fulfilled. According to this configuration, the variation in the electron emission characteristics can be reduced.

Figure 2:
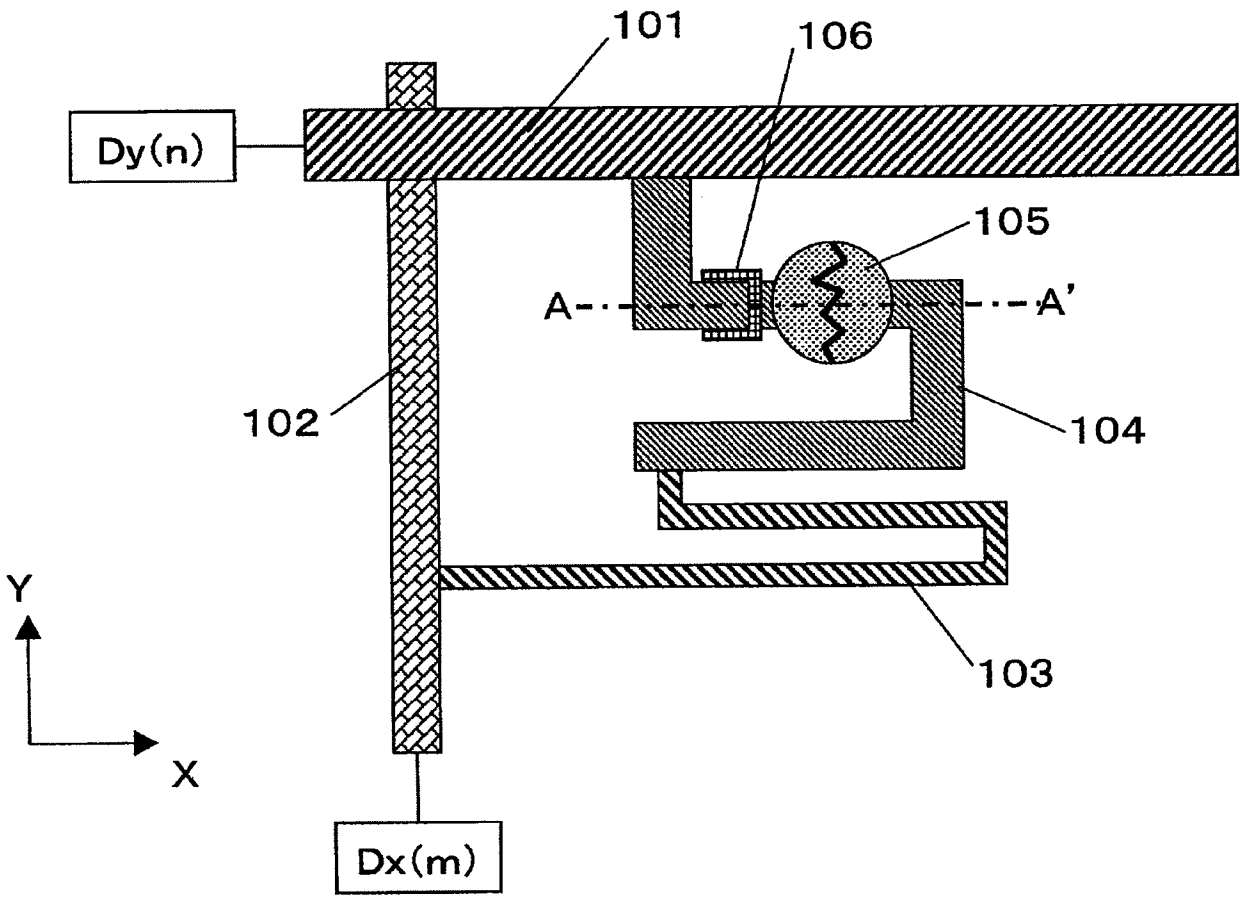
FIG. 2 is a top plan view illustrating an example of a configuration for realizing the circuit configuration of FIG. 1.
Figure 3:
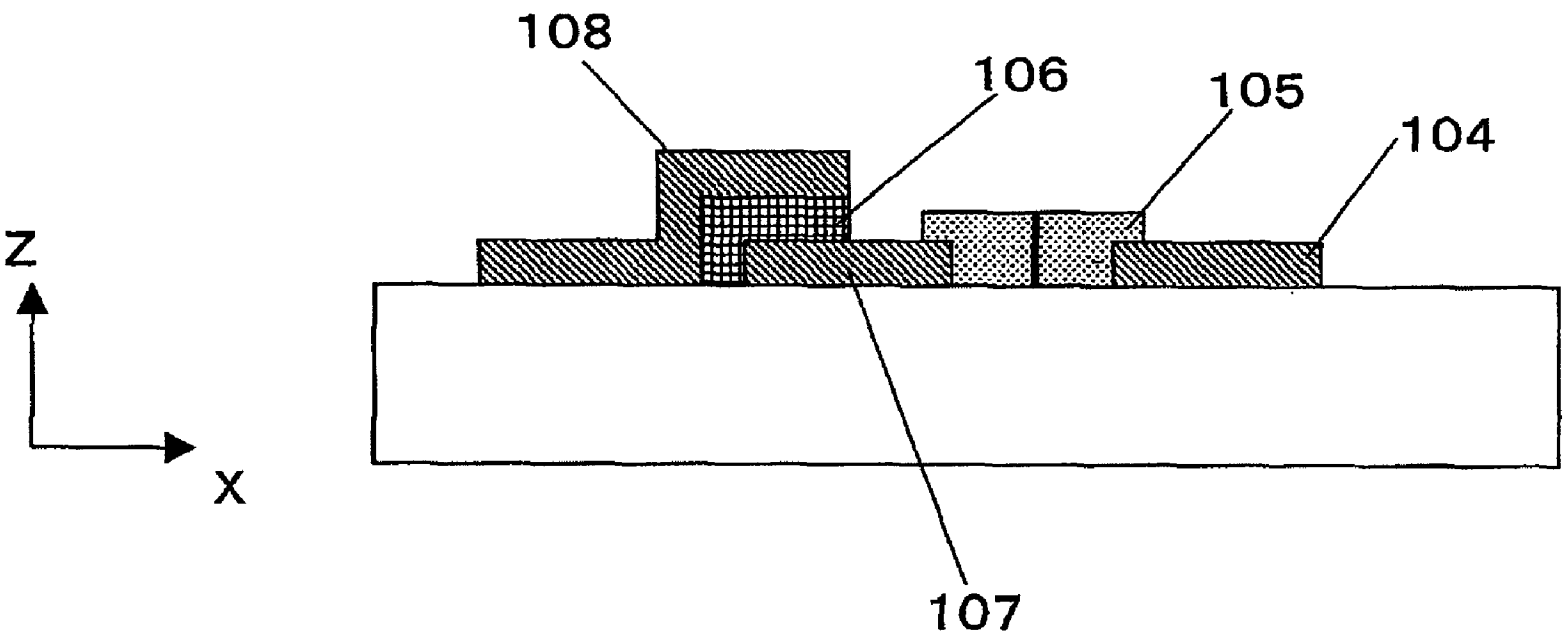
FIG. 3 is a cross-sectional view of FIG. 2.

Next, an example of a configuration for realizing the above circuit configuration will be described using FIGS. 2 and 3. FIG. 2 is a top plan view (a view seen from the face plate side) illustrating an example of a configuration for realizing the above circuit configuration. FIG. 3 is a cross-sectional view obtained by a plane which passes through a dashed-line A-A' of FIG. 2 and is perpendicular to a display surface (on which an image is displayed).

First, a cathode wiring 101 and a gate wring 102 are formed on a glass substrate. The cathode wiring 101 and the gate wring 102 are electrically insulated from each other. The cathode wiring 101 is connected to a terminal Dy (n) connected to a scanning drive circuit, and the gate wring 102 is connected to a terminal Dx (m) connected to a signal drive circuit.

A resistive element 103 is formed by patterning of an electroconductive thin film. The resistive element 103 corresponds to the second resistive element of FIG. 1 (namely, the resistive element 103 has the resistance value Rx). The resistive element 103 is electrically connected to an electron emitting device 105 (a gate electrode) through an electrode 104.

In the example in FIGS. 2 and 3, an impedance element having a resistance value of Ry and an electrostatic capacitance of Cy is connected to between the cathode wiring and a cathode electrode, whereby an RC parallel circuit is realized. Specifically, the impedance element includes sequentially stacked an electrode 107, a resistive element 106, and an electrode 108. The resistive element (the first resistive element having a resistance value of Ry) 106 is electrically connected to the electron emitting device 105 (the cathode electrode) through the electrode 107. In the example in FIGS. 2 and 3, the resistive element 106 is held between the electrodes 107 and 108 to thereby realize the capacitive element having an electrostatic capacitance of Cy. In FIGS. 2 and 3, the electrode 104 and the electrodes 107 and 108 may be formed of the same material as the resistive element 103, or may be formed of different materials.

In the example in FIGS. 2 and 3, one RC parallel circuit is provided for one electron emitting device. However, if a synthetic impedance satisfies the relation of the formula (2), one RC parallel circuit may be provided for a plurality of electron emitting devices. On the other hand, a plurality of RC parallel circuits may be provided for one electron emitting device. A method for realizing a capacitive element may be different from the example in FIGS. 2 and 3. For example, a capacitive element may be realized by such a planar configuration that a material (for example, the resistive element 106) having a predetermined permittivity is provided to be held between the electrodes 107 and 108 disposed on a glass substrate to face each other.

Example

Hereinafter, a specific example of the image display apparatus according to the present embodiment will be described. In this example, a specific example having the configuration illustrated in FIGS. 2 and 3 is described in detail, and the descriptions of the configuration of the face plate and so on will be not be described.

First, the cathode wiring 101 and the gate wiring 102 are formed on a glass substrate. In this example, the cathode wiring 101 is formed by a printing method using a silver paste. The gate wiring 102 is formed by stacking a Cu thin film on a TaN thin film, using a photolithographic method and a sputtering method. The resistance value of the cathode wiring 101 is 5Ω, and the resistance value of the gate wiring 102 is 300Ω. Although not illustrated here, the cathode wiring 101 and the gate wiring 102 are electrically insulated using a $SiO_2$ thin film. The cathode wiring 101 is connected to a terminal Dy (n) connected to a scanning drive circuit, and the gate wiring 102 is connected to a terminal Dx (m) connected to a signal drive circuit.

The electron emitting device 105 is produced by an inkjet method. In this example, six electron emitting devices 105 are provided. In order to confirm the uniformity of the electron emission characteristics (the emission current Ie), it is desirable that a large number of the electron emitting devices 105 are provided; however, one electron emitting device 105 may be provided. Since a method for producing the electron emitting device is disclosed in Japanese Patent No. 3199682, the description will not be described. In this example, the electron emitting device 105 is produced by a method similar to the method disclosed in Japanese Patent No. 3199682.

The resistive element 103 is formed by patterning TaN as an electroconductive thin film, using a photolithographic method and a vapor deposition method. The resistive element 103 is electrically connected to the electron emitting device 105 through the electrode 104. The resistance value Rx of the resistive element 103 is 50 kΩ. In this example, the electrodes 104, 107, and 108 are formed by the material same as the resistive element 103. The electrodes 107 and 108 each have the size of 20 μm in the X (horizontal) direction and 40 μm in the Y (longitudinal) direction, and they are arranged at an interval of 1 μm.

The resistive element 106 is formed to be connected to the electron emitting device 105 through the electrode 107. In the present embodiment, the resistive element 106 is formed by a photolithographic method. Specifically, a paste that is mainly composed of ruthenium oxide and has a volume resistance of 1 kΩ·m is filled in between the electrodes 107 and 108 to be fired at 500° C. for 30 minutes, whereby the paste is provided as the resistive element 106. The resistive element 106 has a resistance value Ry of 1 MΩ and an electrostatic capacitance Cy of 57 fF.

Thus, when the frequency ω is 100 MHz, $|Ry/(1+j\omega RyCy)|$=about 28 kΩ (<Rx). Accordingly, the configuration satisfying the formulas (1) and (2) can be obtained.

The resistive element 106 may be formed of a material other than the paste mainly composed of ruthenium oxide. For example, the resistive element 106 may be formed of a paste in which a metal powder such as Au, Ag, Pd, Ni, Cu, and Ti is dispersed in a titanium oxide paste or a glass powder. As the resistive element 106, a thin film resistor material such as ITO, ATO, IZO, Ta—$SiO_2$, Nb—$SiO_2$, Cr—$SiO_2$, Ta—N, Si—N, and a-Si may be formed by sputtering method.

In the image display apparatus manufactured as above, in order to confirm the effects, abnormal electrical discharge is artificially induced between an anode electrode and an electron emitting device at an arbitrary point. A discharge current in the abnormal electrical discharge is divided into the gate wiring and the cathode wiring based on an impedance ratio of $Ry/(1+j\omega RyCy):Rx$. Consequently, a drive circuit is not damaged. Further, it is confirmed that by virtue of the effect of suppressing the variation in the emission current Ie due to the combined resistance of the resistive element 103 and the resistive element 106, such a favorable image is obtained that causes no significant fluctuation of the electron emission characteristics and variation in characteristics between adjacent devices.

Comparative Example

In order to compare with the image display apparatus according to the above example, an image display apparatus that does not satisfy $|Ry/(1+j\omega RyCy)|<Rx$ is manufactured. Specifically, the impedance ratio to a high-frequency current of 100 MHz:$|Ry/(1+j\omega RyCy)|$:Rx is 6:4. When abnormal electrical discharge is artificially induced in the image display apparatus according to this comparative example, the electron emission amount varies by several ten % between an electron emitting device at a discharge position and an electron emitting device adjacent to the device at the discharge position through the gate wiring. Specifically, an emission luminance of a light emitter varies by several ten %. When abnormal electrical discharge is induced at a position near a signal drive circuit, latch-up of the signal drive circuit may occur.

Specifically, the resistance per one gate wiring is 300Ω, a discharge current is 200 mA, and the impedance ratio of a high-frequency current of 100 MHz:$|Ry/(1+j\omega RyCy)|$:Rx is 6:4. In such display device, the flow division ratio of a discharge current (a current flowing on the gate wiring side:a current flowing on the cathode wiring side) is 120 mA:80 mA. Therefore, the potential near the discharge point is increased by 36 V. Thus, a voltage not less than a rated drive voltage is applied to the electron emitting device. Consequently, the electron emission characteristics are deteriorated by several to several ten %. Since the allowable current of a general signal drive circuit is approximately 50 to 100 mA, an abnormality such as latch-up easily occurs.

As described above, according to the image display apparatus of the present embodiment, the impedance element having a resistance value of Ry and an electrostatic capacitance of Cy is connected to between the cathode wiring and the cathode electrode, and the resistive element having a resistance value of Rx is connected to between the gate wiring and the gate electrode to satisfy formulas (1) and (2). According to this configuration, upon normal driving, by virtue of the resistance value Ry (the ballast resistance), the variation in the electron emission characteristics can be reduced. If accidental electrical discharge occurs, by virtue of the electrostatic capacitance Cy, the inflow of a discharge current into the gate wiring with a large wiring resistance can be suppressed. According to this configuration, the variation in the electron emission characteristics can be reduced also when electrical discharge occurs. Further, a drive circuit can be prevented from being damaged when the electrical discharge occurs.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-094044, filed on Apr. 8, 2009, which is hereby incorporated by reference herein in its entirety.

What is claimed is:

1. An image display apparatus comprising:

a plurality of electron emitting devices having an electron emitting portion provided between a cathode electrode and a gate electrode;

a cathode wiring connected to the cathode electrode; and a gate wiring connected to the gate electrode and having a resistance higher than the resistance of the cathode wiring, wherein an impedance element having a resistance value of Ry and an electrostatic capacitance of Cy is connected to between the cathode wiring and the cathode electrode, a resistive element having a resistance value of Rx is connected to between the gate wiring and the gate electrode, and $|Ry/(1+j\omega RyCy)|<Rx$ and $Ry>Rx$ are satisfied, where $\omega$ is 100 MHz.

2. An image display apparatus comprising:

a plurality of electron emitting devices having an electron emitting portion provided between a cathode electrode and a gate electrode;

a cathode wiring connected to the cathode electrode; and a gate wiring connected to the gate electrode and having a resistance higher than the resistance of the cathode wiring, wherein a first resistive element having a resistance value of Ry and a capacitive element having an electrostatic capacitance of Cy are connected in parallel between the cathode wiring and the cathode electrode, a second resistive element having a resistance value of Rx is connected to between the gate wiring and the gate electrode, and $|Ry/(1+j\omega RyCy)|<Rx$ and $Ry>Rx$ are satisfied, where $\omega$ is 100 MHz.

* * * * *